US007245269B2

(12) United States Patent
Sievenpiper et al.

(10) Patent No.: US 7,245,269 B2
(45) Date of Patent: Jul. 17, 2007

(54) ADAPTIVE BEAM FORMING ANTENNA SYSTEM USING A TUNABLE IMPEDANCE SURFACE

(75) Inventors: Daniel F. Sievenpiper, Santa Monica, CA (US); James H. Schaffner, Chatsworth, CA (US); Gregory L. Tangonan, Oxnard, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 10/844,104

(22) Filed: May 11, 2004

(65) Prior Publication Data

US 2004/0263408 A1 Dec. 30, 2004

Related U.S. Application Data

(60) Provisional application No. 60/470,029, filed on May 12, 2003.

(51) Int. Cl.
*H01Q 15/02* (2006.01)
*H01Q 15/24* (2006.01)
*H01Q 1/38* (2006.01)

(52) U.S. Cl. ..... 343/909; 343/700 MS

(58) Field of Classification Search ..... 343/700 MS, 343/745, 749, 756, 909, 910
See application file for complete search history.

(56) References Cited

U.S. PATENT DOCUMENTS

| | | | | |
|---|---|---|---|---|
| 3,267,480 | A | 8/1966 | Lerner | 343/911 |
| 3,560,978 | A | 2/1971 | Himmel et al. | 343/106 |
| 3,810,183 | A | 5/1974 | Krutsinger et al. | 343/708 |
| 3,961,333 | A | 6/1976 | Purinton | 343/872 |
| 4,045,800 | A | 8/1977 | Tang et al. | 343/854 |
| 4,051,477 | A | 9/1977 | Murphy et al. | 343/700 MS |
| 4,119,972 | A | 10/1978 | Fletcher et al. | 343/844 |
| 4,123,759 | A | 10/1978 | Hines et al. | 343/854 |
| 4,124,852 | A | 11/1978 | Steudel | 343/854 |
| 4,127,586 | A | 11/1978 | Rody et al. | 260/308 B |
| 4,150,382 | A | 4/1979 | King | 343/754 |
| 4,173,759 | A | 11/1979 | Bakhru | 343/100 |
| 4,189,733 | A | 2/1980 | Malm | 343/100 SA |
| 4,217,587 | A | 8/1980 | Jacomini | 343/100 SA |

(Continued)

FOREIGN PATENT DOCUMENTS

DE 196 00 609 A1 4/1997

(Continued)

OTHER PUBLICATIONS

U.S. Appl. No. 10/944,032, Sep. 17, 2004, Sievenpiper.

(Continued)

*Primary Examiner*—Shih-Chao Chen
(74) *Attorney, Agent, or Firm*—Ladas & Parry

(57) ABSTRACT

A method of and apparatus for beam steering. A feed horn is arranged so that the feed horn illuminates a tunable impedance surface comprising a plurality of individually tunable resonator cells, each resonator element having a reactance tunable by a tuning element associated therewith. The tuning elements associated with the tunable impedance surface are adjusted so that the resonances of the individually tunable resonator cells are varied in a sequence and the resonances of the individually tunable resonator cells are set to values which improve transmission of information via the tunable impedance surface and the feed horn.

24 Claims, 9 Drawing Sheets

U.S. PATENT DOCUMENTS

| | | | | |
|---|---|---|---|---|
| 4,220,954 | A | 9/1980 | Marchland | 343/113 R |
| 4,236,158 | A | 11/1980 | Daniel | 343/100 LE |
| 4,242,685 | A | 12/1980 | Sanford | 343/770 |
| 4,266,203 | A | 5/1981 | Saudreau et al. | 333/21 A |
| 4,308,541 | A | 12/1981 | Seidel et al. | 343/786 |
| 4,367,475 | A | 1/1983 | Schiavone | 343/767 |
| 4,370,659 | A | 1/1983 | Chu et al. | 343/772 |
| 4,387,377 | A | 6/1983 | Kandler | 343/756 |
| 4,395,713 | A | 7/1983 | Nelson et al. | 343/713 |
| 4,443,802 | A | 4/1984 | Mayes | 343/729 |
| 4,590,478 | A | 5/1986 | Powers et al. | 343/700 MS |
| 4,594,595 | A | 6/1986 | Struckman | 343/770 |
| 4,672,386 | A | 6/1987 | Wood | 343/770 |
| 4,684,953 | A | 8/1987 | Hall | 343/725 |
| 4,700,197 | A | 10/1987 | Milne | 343/837 |
| 4,737,795 | A | 4/1988 | Nagy et al. | 343/712 |
| 4,749,966 | A | 6/1988 | Tresselt et al. | 343/700 MS |
| 4,760,402 | A | 7/1988 | Mizuno et al. | 343/713 |
| 4,782,346 | A | 11/1988 | Sharma | 343/795 |
| 4,803,494 | A | 2/1989 | Norris et al. | 343/770 |
| 4,821,040 | A | 4/1989 | Johnson et al. | 343/700 MS |
| 4,835,541 | A | 5/1989 | Johnson et al. | 343/713 |
| 4,843,400 | A | 6/1989 | Tsao et al. | 343/700 MS |
| 4,843,403 | A | 6/1989 | Lalezari et al. | 343/767 |
| 4,853,704 | A | 8/1989 | Diaz et al. | 343/767 |
| 4,903,033 | A | 2/1990 | Tsao et al. | 343/700 MS |
| 4,905,014 | A | 2/1990 | Gonzalez et al. | 343/909 |
| 4,916,457 | A | 4/1990 | Foy et al. | 343/770 |
| 4,922,263 | A | 5/1990 | Dubost et al. | 343/797 |
| 4,958,165 | A | 9/1990 | Axford et al. | 343/770 |
| 4,975,712 | A | 12/1990 | Chen | 343/754 |
| 5,021,795 | A | 6/1991 | Masiulis | 343/700 MS |
| 5,023,623 | A | 6/1991 | Kreinheder et al. | 343/725 |
| 5,070,340 | A | 12/1991 | Diaz | 343/767 |
| 5,081,466 | A | 1/1992 | Bitter, Jr. | 343/767 |
| 5,115,217 | A | 5/1992 | McGrath et al. | 333/246 |
| 5,146,235 | A | 9/1992 | Frese | 343/895 |
| 5,158,611 | A | 10/1992 | Ura et al. | 106/499 |
| 5,208,603 | A | 5/1993 | Yee | 343/909 |
| 5,218,374 | A | 6/1993 | Koert et al. | 343/789 |
| 5,235,343 | A | 8/1993 | Audren et al. | 343/816 |
| 5,268,696 | A | 12/1993 | Buck et al. | 342/372 |
| 5,268,701 | A | 12/1993 | Smith | 343/767 |
| 5,287,116 | A | 2/1994 | Iwasaki et al. | 343/700 MS |
| 5,287,118 | A | 2/1994 | Budd | 343/909 |
| 5,402,134 | A | 3/1995 | Miller et al. | 343/742 |
| 5,406,292 | A | 4/1995 | Schnetzer et al. | 343/700 MS |
| 5,519,408 | A | 5/1996 | Schnetzer | 343/767 |
| 5,525,954 | A | 6/1996 | Komazaki et al. | 333/219 |
| 5,531,018 | A | 7/1996 | Saia et al. | 29/622 |
| 5,532,709 | A | 7/1996 | Talty | 343/819 |
| 5,534,877 | A | 7/1996 | Sorbello et al. | 343/700 MS |
| 5,541,614 | A | 7/1996 | Lam et al. | 343/792.5 |
| 5,557,291 | A | 9/1996 | Chu et al. | 343/725 |
| 5,581,266 | A | 12/1996 | Peng et al. | 343/770 |
| 5,589,845 | A | 12/1996 | Yandrofski et al. | 343/909 |
| 5,598,172 | A | 1/1997 | Chekroun | 343/754 |
| 5,611,940 | A | 3/1997 | Zettler | 73/514.16 |
| 5,619,365 | A | 4/1997 | Rhoads et al. | 359/248 |
| 5,619,366 | A | 4/1997 | Rhoads et al. | 359/248 |
| 5,621,571 | A | 4/1997 | Bantli et al. | 359/529 |
| 5,638,946 | A | 6/1997 | Zavracky | 200/181 |
| 5,644,319 | A | 7/1997 | Chen et al. | 343/702 |
| 5,694,134 | A | 12/1997 | Barnes | 343/700 |
| 5,721,194 | A | 2/1998 | Yandrofski et al. | 505/210 |
| 5,767,807 | A | 6/1998 | Pritchett | 342/374 |
| 5,808,527 | A | 9/1998 | De Los Santos | 333/205 |
| 5,815,818 | A * | 9/1998 | Tanaka et al. | 455/522 |
| 5,874,915 | A | 2/1999 | Lee et al. | 342/375 |
| 5,892,485 | A | 4/1999 | Glabe et al. | 343/789 |
| 5,894,288 | A | 4/1999 | Lee et al. | 343/770 |
| 5,905,465 | A | 5/1999 | Olson et al. | 343/700 MS |
| 5,923,303 | A | 7/1999 | Schwengler et al. | 343/853 |
| 5,926,139 | A | 7/1999 | Korisch | 343/702 |
| 5,929,819 | A | 7/1999 | Grinberg | 343/754 |
| 5,943,016 | A | 8/1999 | Snyder, Jr. et al. | 343/700 MS |
| 5,945,951 | A | 8/1999 | Monte et al. | 343/700 MS |
| 5,949,382 | A | 9/1999 | Quan | 343/767 |
| 5,966,096 | A | 10/1999 | Brachat | 343/700 MS |
| 5,966,101 | A | 10/1999 | Haub et al. | 343/767 |
| 6,005,519 | A | 12/1999 | Burns | 343/700 MS |
| 6,005,521 | A | 12/1999 | Suguro et al. | 343/700 MS |
| 6,008,770 | A | 12/1999 | Sugawara | 343/767 |
| 6,016,125 | A | 1/2000 | Johansson | 343/702 |
| 6,028,561 | A | 2/2000 | Takei | 343/767 |
| 6,028,692 | A | 2/2000 | Rhoads et al. | 359/245 |
| 6,034,644 | A | 3/2000 | Okabe et al. | 343/767 |
| 6,034,655 | A | 3/2000 | You | 345/60 |
| 6,037,905 | A | 3/2000 | Koscica et al. | 343/701 |
| 6,040,803 | A | 3/2000 | Spall | 343/700 MS |
| 6,046,655 | A | 4/2000 | Cipolla | 333/137 |
| 6,046,659 | A | 4/2000 | Loo et al. | 333/362 |
| 6,054,659 | A | 4/2000 | Lee et al. | 200/181 |
| 6,061,025 | A | 5/2000 | Jackson et al. | 343/700 MS |
| 6,075,485 | A | 6/2000 | Lilly et al. | 343/700 MS |
| 6,081,235 | A | 6/2000 | Romanofsky et al. | 343/700 MS |
| 6,081,239 | A | 6/2000 | Sabet et al. | 343/753 |
| 6,097,263 | A | 8/2000 | Mueller et al. | 333/17.1 |
| 6,097,343 | A | 8/2000 | Goetz et al. | 343/708 |
| 6,118,406 | A | 9/2000 | Josypenko | 343/700 MS |
| 6,118,410 | A | 9/2000 | Nagy | 343/713 |
| 6,127,908 | A | 10/2000 | Bozler et al. | 333/246 |
| 6,150,989 | A | 11/2000 | Aubry | 343/767 |
| 6,154,176 | A | 11/2000 | Fathy et al. | 343/700 MS |
| 6,166,705 | A | 12/2000 | Mast et al. | 343/853 |
| 6,175,337 | B1 | 1/2001 | Jasper, Jr. et al. | 343/770 |
| 6,175,723 | B1 | 1/2001 | Rothwell, III | 455/63 |
| 6,188,369 | B1 | 2/2001 | Okabe et al. | 343/767 |
| 6,191,724 | B1 | 2/2001 | McEwan | 342/21 |
| 6,198,438 | B1 | 3/2001 | Herd et al. | 343/700 MS |
| 6,198,441 | B1 | 3/2001 | Okabe et al. | 343/702 |
| 6,204,819 | B1 | 3/2001 | Hayes et al. | 343/702 |
| 6,218,912 | B1 | 4/2001 | Mayer | 333/106 |
| 6,218,997 | B1 | 4/2001 | Lindenmeier et al. | 343/725 |
| 6,246,377 | B1 | 6/2001 | Aiello et al. | 343/700 |
| 6,252,473 | B1 | 6/2001 | Ando | 333/105 |
| 6,285,325 | B1 | 9/2001 | Nalbandian et al. | 343/700 MS |
| 6,307,519 | B1 | 10/2001 | Livingston et al. | 343/767 |
| 6,317,095 | B1 | 11/2001 | Teshirogi et al. | 343/785 |
| 6,323,826 | B1 | 11/2001 | Sievenpiper et al. | 343/909 |
| 6,331,257 | B1 | 12/2001 | Loo et al. | 216/13 |
| 6,337,668 | B1 | 1/2002 | Ito et al. | 343/833 |
| 6,366,254 | B1 | 4/2002 | Sievenpiper et al. | 343/700 |
| 6,373,349 | B2 | 4/2002 | Gilbert | 333/126 |
| 6,380,895 | B1 | 4/2002 | Moren et al. | 343/700 MS |
| 6,388,631 | B1 | 5/2002 | Livingston et al. | 343/767 |
| 6,392,610 | B1 | 5/2002 | Braun et al. | 343/876 |
| 6,404,390 | B2 | 6/2002 | Sheen | 343/700 MS |
| 6,404,401 | B2 | 6/2002 | Gilbert et al. | 343/780 |
| 6,407,719 | B1 | 6/2002 | Ohira et al. | 343/893 |
| 6,417,807 | B1 | 7/2002 | Hsu et al. | 343/700 MS |
| 6,424,319 | B2 | 7/2002 | Ebling et al. | 343/911 L |
| 6,426,722 | B1 | 7/2002 | Sievenpiper et al. | 343/700 MS |
| 6,440,767 | B1 | 8/2002 | Loo et al. | 438/52 |
| 6,469,673 | B2 | 10/2002 | Kaiponen | 343/703 |
| 6,473,362 | B1 | 10/2002 | Gabbay | 367/119 |
| 6,483,480 | B1 | 11/2002 | Sievenpiper et al. | 343/909 |
| 6,496,155 | B1 | 11/2002 | Sievenpiper et al. | 343/770 |
| 6,518,931 | B1 | 2/2003 | Sievenpiper | 343/700 |
| 6,525,695 | B2 * | 2/2003 | McKinzie, III | 343/756 |
| 6,538,621 | B1 | 3/2003 | Sievenpiper et al. | 343/909 |
| 6,515,635 | B2 | 4/2003 | Chiang et al. | 343/834 |
| 6,552,696 | B1 | 4/2003 | Sievenpiper et al. | 343/909 |

| | | | | |
|---|---|---|---|---|
| 6,624,720 | B1 | 9/2003 | Allison et al. | 333/105 |
| 6,642,889 | B1 | 11/2003 | McGrath | 343/700 MS |
| 6,657,525 | B1 | 12/2003 | Dickens et al. | 335/78 |
| 6,741,207 | B1 | 5/2004 | Allison et al. | 342/371 |
| 6,822,622 | B2 | 11/2004 | Crawford et al. | 343/909 |
| 6,864,848 | B2 | 3/2005 | Sievenpiper | 343/767 |
| 6,897,810 | B2 | 5/2005 | Dai et al. | 343/700 MS |
| 6,897,831 | B2 * | 5/2005 | McKinzie et al. | 343/909 |
| 6,917,343 | B2 * | 7/2005 | Sanchez et al. | 343/795 |
| 2001/0035801 | A1 | 11/2001 | Gilbert | 333/126 |
| 2002/0036586 | A1 | 3/2002 | Gothard et al. | 342/374 |
| 2003/0122721 | A1 | 7/2003 | Sievenpiper | 343/767 |
| 2003/0193446 | A1 | 10/2003 | Chen | 343/893 |
| 2003/0222738 | A1 | 12/2003 | Brown et al. | 333/206 |
| 2003/0227351 | A1 | 12/2003 | Sievenpiper | 333/105 |
| 2004/0113713 | A1 | 6/2004 | Zipper et al. | 333/103 |
| 2004/0135649 | A1 | 7/2004 | Sievenpiper | 333/105 |
| 2004/0227583 | A1 | 11/2004 | Shaffner et al. | 333/32 |
| 2004/0227667 | A1 | 11/2004 | Sievenpiper | 343/700 MS |
| 2004/0227668 | A1 | 11/2004 | Sievenpiper | 343/700 MS |
| 2004/0227678 | A1 | 11/2004 | Sievenpiper | 343/702 |
| 2004/0263408 | A1 | 12/2004 | Sievenpiper | 343/757 |
| 2005/0012667 | A1 | 1/2005 | Noujeim | 343/700 MS |

FOREIGN PATENT DOCUMENTS

| | | | |
|---|---|---|---|
| EP | 0 539 297 | | 4/1993 |
| EP | 1 158 605 | A1 | 11/2001 |
| FR | 2 785 476 | | 5/2000 |
| GB | 1145208 | | 3/1969 |
| GB | 2 281 662 | | 3/1995 |
| GB | 2 328 748 | | 3/1999 |
| JP | 61-260702 | | 11/1986 |
| WO | 94/00891 | | 1/1994 |
| WO | 96/29621 | | 9/1996 |
| WO | 98/21734 | | 5/1998 |
| WO | 99/50929 | | 10/1999 |
| WO | 00/44012 | | 7/2000 |
| WO | 01/31737 | | 5/2001 |
| WO | 01/73891 | A1 | 10/2001 |
| WO | 01/73893 | A1 | 10/2001 |
| WO | 03/098732 | A1 | 11/2003 |

OTHER PUBLICATIONS

Brown, W.C., "The History of Power Transmission by Radio Waves," *IEEE Transactions on Microwave Theory and Techniques*, vol. MTT-32, No. 9, pp. 1230-1242 (Sep. 1984).

Fay, P., et al., "High-Performance Antimonide-Based Heterostructure Backward Diodes for Millimeter-Wave Detection," *IEEE Electron Device Letters*, vol. 23, No. 10, pp. 585-587 (Oct. 2002).

Gold, S.H.,et al., "Review of High-Power Microwave Source Research," *Rev. Sci. Instrum.*, vol. 68, No. 11, pp. 3945-3974 (Nov. 1997).

Koert, P., et al., "Millimeter Wave Technology for Space Power Beaming," *IEEE Transactions on Microwave Theory and Techniques*, vol. 40, No. 6, pp. 1251-1258 (Jun. 1992).

Lezec, H.J., et al., "Beaming Light from a Subwavelength Aperture," *Science*, vol. 297, pp. 820-821 (Aug. 2, 2002).

McSpadden, J.O.,et al., "Design and Experiments of a High-Conversion-Efficiency 5.8-GHz Rectenna," *IEEE Transactions on Microwave Theory and Techniques*, vol. 46, No. 12, pp. 2053-2060 (Dec. 1998).

Schulman, J.N., et al., "Sb-Heterostructure Interband Backward Diodes," *IEEE Electron Device Letters*, vol. 21, No. 7, pp. 353-355 (Jul. 2000).

Sievenpiper, D., et al., "Beam Steering Microwave Reflector Based On Electrically Tunable Impedance Surface," *Electronics Letters*, vol. 38, No. 21, pp. 1237-1238 (Oct. 1, 2002).

Sievenpiper, D.F., et al., "Two-Dimensional Beam Steering Using an Electrically Tunable Impedance Surface," *IEEE Transactions on Antennas and Propagation*, vol. 51, No. 10, pp. 2713-2722 (Oct. 2003).

Strasser, B., et al., "5.8-GHz Circularly Polarized Rectifying Antenna for Wireless Microwave Power Transmission," *IEEE Transactions on Microwave Theory and Techniques*, vol. 50, No. 8, pp. 1870-1876 (Aug. 2002).

Swartz, N., "Ready for CDMA 2000 1xEV-Do?," *Wireless Review*, 2 pages total (Oct. 29, 2001).

Yang, F.R., et al., "A Uniplanar Compact Photonic-Bandgap (UC-PBG) Structure and Its Applications for Microwave Circuits," *IEEE Transactions on Microwave Theory and Techniques*, vol. 47, No. 8, pp. 1509-1514 (Aug. 1999).

Bushbeck, M.D., et al., "a Tunable Switcher Dielectric Grating," *IEEE Microwave and Guided Wave Letters*, vol. 3, No. 9, pp. 296-298 (Sep. 1993).

Chambers, B., et al., "Tunable Radar Absorbers Using Frequency Selective Surfaces," *11th International Conference on Antennas and Propagation*, vol. 50, pp. 832-835 (2002).

Chang, T.K., et al., "Frequency Selective Surfaces on Biased Ferrite Substrates," *Electronics Letters*, vol. 30, No. 15, pp. 1193-1194 (Jul. 21, 1994).

Gianvittorio, J.P., et al., "Reconfigurable MEMS-enabled Frequency Selective Surfaces," *Electronic Letters*, vol. 38, No. 25, pp. 1627-1628 (Dec. 5, 2002).

Lima, A.C., et al., "Tunable Frequency Selective Surfaces Using Liquid Substrates," *Electronic Letters*, vol. 30, No. 4, pp. 281-282 (Feb. 17, 1994).

Oak, A.C., et al. "A Varactor Tuned 16 Element MESFET Grid Oscillator," *Antennas and Propagation Society International Symposium*. pp. 1296-1299 (1995).

U.S. Appl. No. 10/786,736, filed Feb. 24, 2004, Schaffner et al.

U.S. Appl. No. 10/792,411, filed Mar. 2, 2004, Sievenpiper.

U.S. Appl. No. 10/792,412, filed Mar. 2, 2004, Sievenpiper.

U.S. Appl. No. 10/836,966, filed Apr. 30, 2004, Sievenpiper.

Balanis, C., "Aperture Antennas," *Antenna Theory, Analysis and Design* , 2nd Edition, Ch. 12, pp. 575-597 (1997).

Balanis, C., "Microstrip Antennas," *Antenna Theory, Analysis and Design*, 2nd Edition, Ch. 14, pp. 722-736 (1997).

Bialkowski, M.E., et al., "Electronically Steered Antenna System for the Australian Mobilesat," *IEE Proc.-Microw. Antennas Propag.*, vol. 143, No. 4, pp. 347-352 (Aug. 1996).

Bradley, T.W., et al., "Development Of A Voltage-Variable Dielectric (VVD), Electronic Scan Antenna," *Radar 97*, Publication No. 449, pp. 383-385 (Oct. 1997).

Chen, P.W., et al., "Planar Double-Layer Leaky Wave Microstrip Antenna," *IEEE Transactions on Antennas and Propagation*, vol. 50, pp. 832-835 (2002).

Chen, Q., et al., "FDTD diakoptic design of a slot-loop antenna excited by a coplanar waveguide," *Proceedings of the 25th European Microwave Conference 1995*, vol. 2, Conf. 25, pp. 815-819 (Sep. 4, 1995).

Cognard, J., "Alignment of Nematic Liquid Crystals and Their Mixtures," *Mol. Cryst. Liq., Cryst. Suppl. 1*, pp. 1-74 (1982).

Doane, J.W., et al., "Field Controlled Light Scattering from Nematic Microdroplets," *Appl. Phys. lett.*, vol. 48, pp. 269-271 (Jan. 1986).

Ellis, T.J., et al., "MM-Wave Tapered Slot Antennas on Micromachined Photonic Bandgap Dielectrics," *1996 IEEE MTT-S International Microwave Symposium Digest*, vol. 2, pp. 1157-1160 (1996).

Grbic, A., et al., "Experimental Verification of Backward Wave Radiation From A Negative Refractive Index Metamaterial," *Journal of Applied Physics*, vol. 92, No. 10, pp. 5930-5935 (Nov. 15, 2002).

Hu, C.N., et al., "Analysis and Design of Large Leaky-Mode Array Employing The Coupled-Mode Approach," *IEEE Transactions on Microwave Theory and Techniques*, vol. 49, No. 4, pp. 629-636 (Apr. 2001).

Jablonski, W., et al., "Microwave Schottky Diode With Beam-Lead Contacts," *13th Conference on Microwaves, Radar and Wireless Communications*, MIKON-2000, vol. 2, pp. 678-681 (2000).

Jensen, M.A., et al., "EM Interaction of Handset Antennas and a Human in Personal Communications," *Proceedings of the IEEE*, vol. 83, No. 1, pp. 7-17 (Jan. 1995).

Jensen, M.A., et al., "Performance Analysis of Antennas for Handheld Transceivers Using FDTD," *IEEE Transactions on Antennas and Propagation*, vol. 42, No. 8, pp. 1106-1113 (Aug. 1994).

Lee, J.W., et al., "TM-Wave Reduction From Grooves In A Dielectric-Covered Ground Plane," *IEEE Transactions on Antennas and Propagation*, vol. 49, No. 1, pp. 104-105 (Jan. 2001).

Linardou, I., et al., "Twin Vivaldi Antenna Fed By Coplanar Waveguide," *Electronics Letters*, vol. 33, No. 22, pp. 1835-1837 (1997).

Malherbe, A., et al., "The Compenasation of Step Discontinues in TEM-Mode Transmission Lines," *IEEE Transactions on Microwave Theory and Techniques*, vol. MTT-26, No. 11, pp. 883-885 (Nov. 1978).

Maruhashi, K., et al., "Design and Performance of a *Ka*-Band Monolithic Phase Shifter Utilizing Nonresonant FET Switches," *IEEE Transactions on Microwave Theory and Techniques*, vol. 48, No. 8, pp. 1313-1317 (Aug. 2000).

Perini, P., et al., "Angle and Space Diversity Comparisons in Different Mobile Radio Environments," *IEEE Transactions on Antennas and Propagation*, vol. 46, No. 6, pp. 764-775 (Jun. 1998).

Ramo, S., et al., *Fields and Waves in Communication Electronics*, 3rd Edition, Sections 9.8-9.11, pp. 476-487(1994).

Rebeiz, G.M., et al., "RF MEMS Switches and Switch Circuits," *IEEE Microwave Magazine*, pp. 59-71 (Dec. 2001).

Schaffner, J., et al., "Reconfigurable Aperture Antennas Using RF MEMS Switches for Multi-Octave Tunability and Beam Steering," *IEEE Antennas and Propagation Society International Symposium, 2000 Digest*, vol. 1 of 4, pp. 321-324 (Jul. 16, 2000).

Semouchkina, E., et al., "Numerical Modeling and Experimental Study of A Novel Leaky Wave Antenna," *Antennas and Propagation Society*, IEEE International Symposium, vol. 4, pp. 234-237 (2001).

Sievenpiper, D., et al., "Eliminating Surface Currents With Metallodielectric Photonic Crystals," *1998 MTT-S International Microwave Symposium Digest*, vol. 2, pp. 663-666 (Jun. 7, 1998).

Sievenpiper, D., et al., "High-Impedance Electromagnetic Surfaces with a Forbidden Frequency Band," *IEEE Transactions on Microwave Theory and Techniques*, vol. 47, No. 11, pp. 2059-2074 (Nov. 1999).

Sievenpiper, D., et al., "High-Impedance Electromagnetic Surfaces," *Ph.D. Dissertation*, Dept. Of Electrical Engineering, University of California, Los Angeles, CA, pp. i-xi, 1-150 (1999).

Sievenpiper, D., et al., "Low-Profile, Four Sector Diversity Antenna On High-Impedance Ground Plane," *Electronics Letters*, vol. 36, No. 16, pp. 1343-1345 (Aug. 3, 2000).

Sor, J., et al., "A Reconfigurable Leaky-Wave/Patch Microstrip Aperture For Phased-Array Applications," *IEEE Transactions on Microwave Theory and Techniques*, vol. 50, No. 8, pp. 1877-1884 (Aug. 2002).

Vaughan, Mark J., et al., "InP-Based 28 $Gh_z$ Integrated Antennas for Point-to-Multipoint Distribution," *Proceedings of the IEEE/Cornell Conference on Advanced Concepts in High Speed Semiconductor Devices and Circuits*, pp. 75-84 (1995).

Vaughan, R., "Spaced Directive Antennas for Mobile Communications by the Fourier Transform Method," *IEEE Transactions on Antennas and Propagation*, vol. 48, No. 7, pp. 1025-1032 (Jul. 2000).

Wang, C.J., et al., "Two-Dimensional Scanning Leaky-Wave Antenna by Utilizing the Phased Array," *IEEE Microwave and Wireless Components Letters*, vol. 12, No. 8, pp. 311-313, (Aug. 2002).

Wu, S.T., et al., "High Birefringence and Wide Nematic Range Bis-Tolane Liquid Crystals," *Appl. Phys. Lett.*, vol. 74, No. 5, pp. 344-346 (Jan. 18, 1999).

Yang, Hung-Yu David, et al., "Theory of Line-Source Radiation From A Metal—Strip Grating Dielectric-Slab Structure," *IEEE Transactions on Antennas and Propagation*, vol. 48, No. 4, pp. 556-564 (2000).

Yashchyshyn, Y., et al., "The Leaky-Wave Antenna With Ferroelectric Substrate," *14th International Conference on Microwaves, Radar and Wireless Communications*, MIKON-2002, vol. 2, pp. 218-221 (2002).

* cited by examiner

ADAPTIVE BEAM FORMING ANTENNA SYSTEM USING A TUNABLE IMPEDANCE SURFACE

CROSS REFERENCE TO RELATED APPLICATIONS AND PATENTS

This application claims the benefit of U.S. Provisional Patent Application No. 60/470,029 filed May 12, 2003.

This application is related to the following U.S. patent applications: U.S. patent application Ser. No. 09/537,923 filed Mar. 29, 2000 (now U.S. Pat. No. 6,538,621) and U.S. patent application Ser. No. 09/589,859 filed Jun. 8, 2000 (now U.S. Pat. No. 6,483,480). The disclosures of these two applications are incorporated herein by reference.

This application is related to the disclosure of U.S. Pat. No. 6,496,155 to Sievenpiper et al., which is hereby incorporated by reference. This application is also related to the disclosure of U.S. Provisional Patent Application Ser. No. 60/470,028 filed on May 12, 2003 entitled "Steerable Leaky Wave Antenna Capable of Both Forward and Backward Radiation" and to the disclosure of U.S. Provisional Patent Application Ser. No. 60/470,027 filed on May 12, 2003 entitled "Meta-Element Antenna and Array" and the foregoing applications related non-provisional applications. The disclosures of these related applications are incorporated herein by reference.

This application is also related to the disclosures of U.S. Pat. Nos. 6,538,621 and 6,552,696 all to Sievenpiper et al., both of which are hereby incorporated by reference.

TECHNICAL FIELD

The presently disclosed technology relates to a low-cost adaptive antenna system. The antenna contains (1) an electrically tunable impedance surface, (2) a microwave receiver, (3) a feedback mechanism, and (4) an adaptive method of adjusting the surface impedance to optimize some parameter. The parameter to be optimized can be (a) maximum received power in one or more directions, (b) minimum received power in one or more directions, such as to eliminate a jamming source, or (c) a combination of the foregoing. The presently disclosed technology also relates to a method of beam steering

BACKGROUND AND PRIOR ART

The prior art includes the following:

(1) The tunable impedance surface, invented at HRL Laboratories of Malibu, Calif. See, for example, the following U.S. Pat. Nos.: 6,483,480; Sievenpiper, and Sievenpiper, U.S. Pat. No. 6,538,621. The tunable impedance surface is described in various incarnations, including electrically and mechanically tunable versions. However, the tuning technology disclosed herein is different in that relates to a tuning method that allows for the independent control of the phase preferably at each element of the tunable impedance surface.

(2) Phased array antennas. These are described in numerous patents and publications, and references. See, for example, U.S. patents by Tang, U.S. Pat. No. 4,045,800; Fletcher, U.S. Pat. No. 4,119,972; Jacomini, U.S. Pat. No. 4,217,587; Steudel, U.S. Pat. No. 4,124,852; and Hines, U.S. Pat. No. 4,123,759. Phased array antennas are typically built as arrays of independent receiving elements, each with a phase shifter. Signals are collected from each element and combined with the appropriate phase to form a beam or null in the desired direction. The disadvantage of the phased array compared to the present technology is that it is prohibitively expensive for many applications.

(3) Adaptive antennas. These are also described in numerous patents and publications, and references. See, for example, U.S. Patents by Daniel, U.S. Pat. No. 4,236,158; Marchand, U.S. Pat. No. 4,220,954; McGuffin, U.S. Pat. No. 4,127,586; Malm, 4,189,733; and Bakhru, U.S. Pat. No. 4,173,759. Adaptive antennas include analog or digital signal processing techniques that are used for angle of arrival estimation, adaptive beam forming, adaptive null forming, including the ability to track multiple sources or jammers. The disadvantage of traditional adaptive antenna methods compared to the present disclosure is the required complexity. Many of the same functions that are used in traditional adaptive antennas are handled by the presently disclosed technology using much simpler techniques.

(4) The prior art also includes the ESPAR antenna system developed by Ohria, U.S. Pat. No. 6,407,719. This antenna involves a series of passive antenna elements and a single driven antenna element. The resonance frequencies of the passive antenna elements are adjusted to vary the coupling coefficients among them, and to steer a beam or a null. The presently disclosed technology is related to this antenna in that it preferably uses passive, non-driven resonators as the beam forming apparatus. However, the presently disclosed antenna technology allows much higher gain because it allows the radiation striking a large area to be directed to a single feed, rather than relying exclusively on mutual coupling among the elements.

The technology disclosed herein improves upon the existing state of the art in that it provides a lower cost alternative to traditional phased arrays, while retaining the same functionality, including the ability to adaptively modify the phase profile by measuring a small number of parameters. Phased arrays are typically expensive, often costing hundreds of thousands or millions of dollars per square meter for an array operating at several GHz. The technology disclosed herein utilizes a tunable impedance surfaces, a concept that has been described in the U.S. Patents referred to above, but the presently disclosed technology provides the ability to adaptively modify the reflection phase to optimize a variety of parameters. If the number of measured variables is limited, then this method further reduces the cost compared to conventional techniques. Calculations that ordinarily require complex digital signal processing are handled naturally by the adaptive array without difficult data processing requirements.

The technology disclosed herein can be used in a variety of applications. For example, it can be used for a low-cost communication system. It can also be used for a low-cost in-flight Internet system on aircraft, where data would be directed to passengers or users in various parts of an aircraft. Since the technology disclosed herein is blind to the incoming phase profile, it is able to partially mitigate multipath problems. It can also be used as a low-cost beamforming technique for information kiosk applications or for 3G wireless networking, in order to provide much greater performance in a vehicle, for example, than is possible with handsets.

An advantage of the present technology compared to a conventional phased array, besides the fact that this technology is comparatively inexpensive to implement, is that conventional phased arrays typically involve explicit control of the phase of a lattice of antennas, while in the antenna systems disclosed herein, the phase at each point on the surface is an intermediate state that exists, but has no direct bearing on the control of the array. In other words, the user does not need to calibrate the array to know its phase, because the antenna can be steered using the method disclosed herein without explicit knowledge of the phase. Conventional phased arrays, on the other hand, typically require explicit knowledge of the phase at each point in the array.

SUMMARY

In one aspect, the present disclosure relates a method of beam steering which includes arranging an antenna, such as feed horn operating at microwave frequencies, so that the antenna illuminates a tunable impedance surface comprising a plurality of individually tunable resonator elements, each resonator element having a reactance tunable by a tuning element associated therewith and adjusting the tuning elements associated with the tunable impedance surface so that the resonances of the individually tunable resonator elements are varied in sequence and setting the resonances of the individually tunable resonator elements to values which improve transmission of information via said tunable impedance surface and said feed horn.

In another aspect, the present disclosure relates a method of beam steering that includes:

a. arranging an antenna, such as feed horn, so that the antenna illuminates a tunable impedance surface comprising a plurality of individually tunable resonator elements, each resonator element being tunable by a tuning element associated therewith;
b. applying an initial set of control voltages to the tuning elements associated with the tunable impedance surface;
c. adjusting (or dithering) the control voltage up and down by a small amount v for a selected one of the resonator elements;
d. transmitting and/or receiving an RF signal which is reflected from the tunable impedance surface and measuring a parameter associated with the power of the transmitted and/or received RF signal for the cases of −v, 0, and +v adjustments of the control voltage for said selected one of the resonator elements;
e. noting a best value of the control voltage of the three cases and setting the control voltage accordingly for said selected one of the resonator elements and adjusting the control voltage up and down by said small amount v for another selected one of the resonator elements;
f. repeating steps d and e to adjust each of the individually tunable resonator elements associated with the tunable impedance surface; and
g. repeating steps c–f to adjust all tuning elements associated with the tunable impedance surface in a continuous cycle for a period of time.

In yet another aspect the present disclosure relates a communication system including: an antenna; a tunable impedance surface disposed to reflect RF radiation between at least one communications link and the antenna, the tunable impedance surface having a plurality of individually tunable resonator elements arranged in a two dimensional array, each resonator element having a reactance that is tunable by at least one tuning element associated therewith; and a receiver and controller coupled to said antenna, the receiver and controller including a signal discriminator for measuring one or more parameters associated with communication quality of service over said at least one communications link, the receiver and controller sequentially adjusting the tuning elements associated with the individually tunable resonator elements in said tunable impedance surface in order to improve the communication quality of service over said at least one communications link.

DETAILED DESCRIPTION OF A PREFERRED EMBODIMENT

Figure 1A:
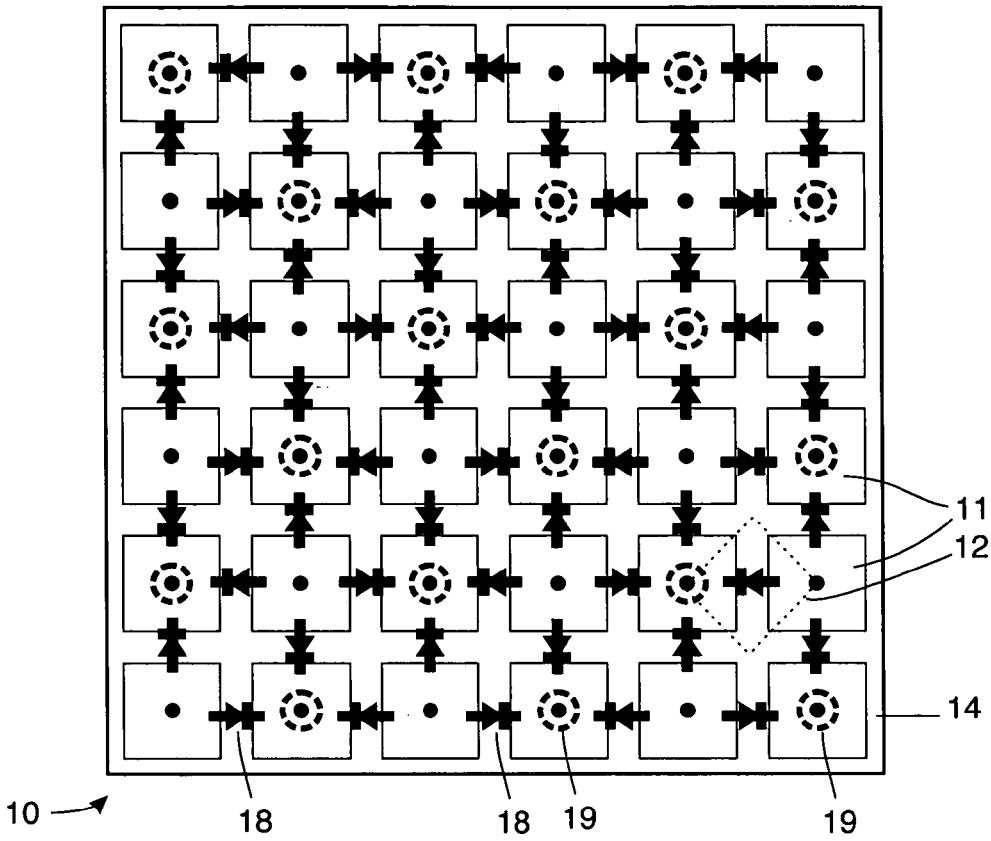
FIG. 1*a* is a top plan view of a portion of the tunable impedance surface, which forms the beam forming or defining apparatus of the disclosed technology.
Figure 1B:
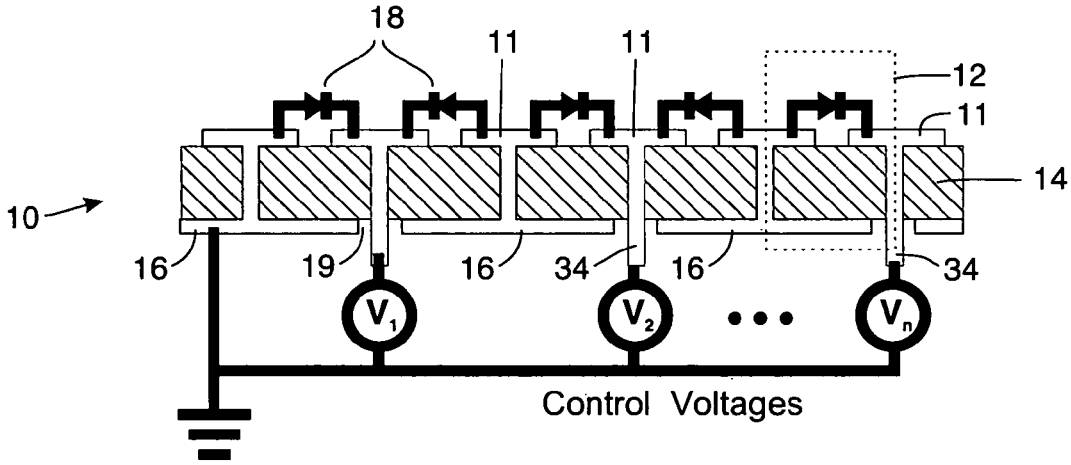
FIG. 1*b* is a side elevation of the tunable impedance surface of FIG. 1*a;*

The technology disclosed herein preferably utilizes a tunable impedance surface, which surface has been disclosed in previous patents and patent applications noted above. An embodiment of an electrically tunable version of such a surface 10 is shown in FIGS. 1*a* and 1*b*. The tunable impedance surface 10 is preferably constructed as an array of small (much less than one wavelength in size on a side thereof) resonators cells 12 each of which can be considered as a LC circuit with an inductance L and a capacitance C. The array of resonator cells 12 are preferably defined by an array of plates 11 disposed on a dielectric surface 14 and in close proximity to a ground plane 16 (typically the dielectric surface has a thickness less than one tenth of a wavelength as the frequency of interest). This surface 10 is tuned using resonator tuning elements or means such as varactor diodes 18 that provide a variable capacitance that depends on a control voltage $V_1, V_2 \ldots V_n$. The applied voltage is applied on control lines 34 which preferably penetrate the ground plane 16 through openings 19 therein in order to apply a separate control voltage to each tuning element 18. The surface 10 can also be tuned by other tuning means, including mechanical elements (such as MEMS capacitors) and otherwise. See, for example, U.S. Pat. Nos. 6,483,480 and 6,538,621 noted above.

The plates 11 may each be square shaped as shown in FIG. 1*a* or may have another geometric shape, such as a triangular, hexagonal, or other convenient repeating geometric shape or mixture thereof. The number of sides each plate 11 tends to limit the number of tuning elements 18 associated with each plate 11 (multiple varactor diodes 18 could be associated with a single side of a plate 11—for example, two varactor diodes could be coupled in parallel on a single side of a plate 11 with their polarities reversed so that one or the other would be controlled according to polarity of the applied control voltage). Also, as the number of sides increases, so does the number of possible tuning elements 18 associated with each plate 11. In the embodiment of FIGS. 1*a* and 1*b*, the voltage on a single control line 34 affects four varactor diodes 18. But, in order to reduce the cost of manufacturing the tunable impedance surface 10, some of the positions where tuning elements 18 may possibly be provided could be omitted as a matter of design choice.

The surface 10 has a resonance frequency of $$\frac{1}{\sqrt{LC}},$$

and at this resonance frequency the reflection phase is zero, as opposed to $\pi$, which is the reflection phase of an ordinary metal surface. The reflection phase varies from $\pi$ to $-\pi$ as the frequency of interest is swept through the resonance frequency. See FIG. 3*b*.

Figure 2:
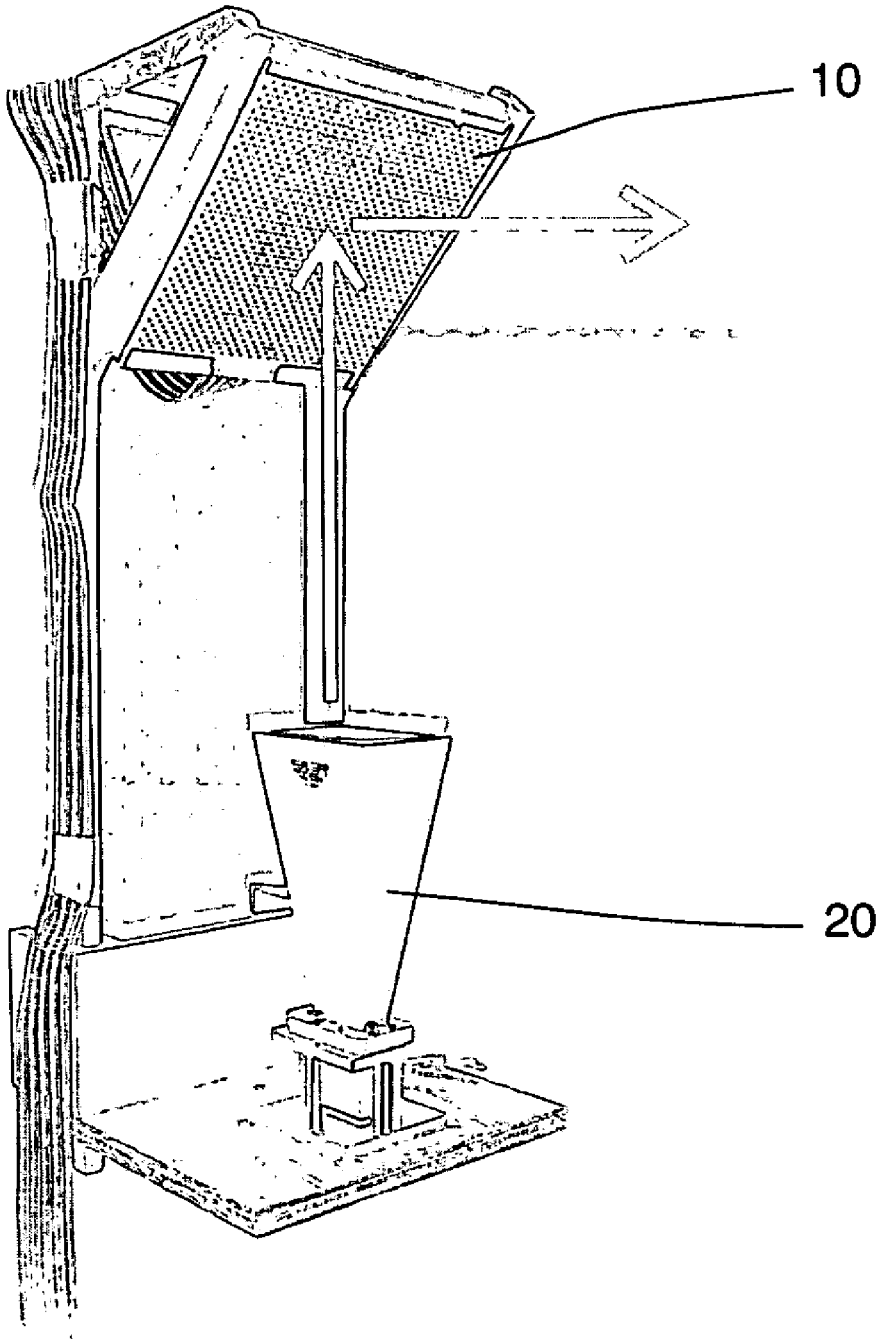
FIG. 2 depicts an arrangement and method of distributing RF power from the feed horn onto the tunable impedance surface.

Conversely, by tuning the resonance frequency, one can tune the reflection phase for a fixed frequency. This tunable phase surface 10 can be used to steer a microwave beam, in much the same way as a conventional phased array. The phase across the surface is adjusted so that an incoming wave (see FIG. 3*a*) sees a phase gradient, and the beam is steered to an angle that is determined by that phase gradient. A steerable antenna can be built by illuminating the surface with microwave energy from an antenna, such as feed horn 20 shown in FIG. 2. The energy from the feed horn is steered upon reflection by the surface 10.

Figure 3A:
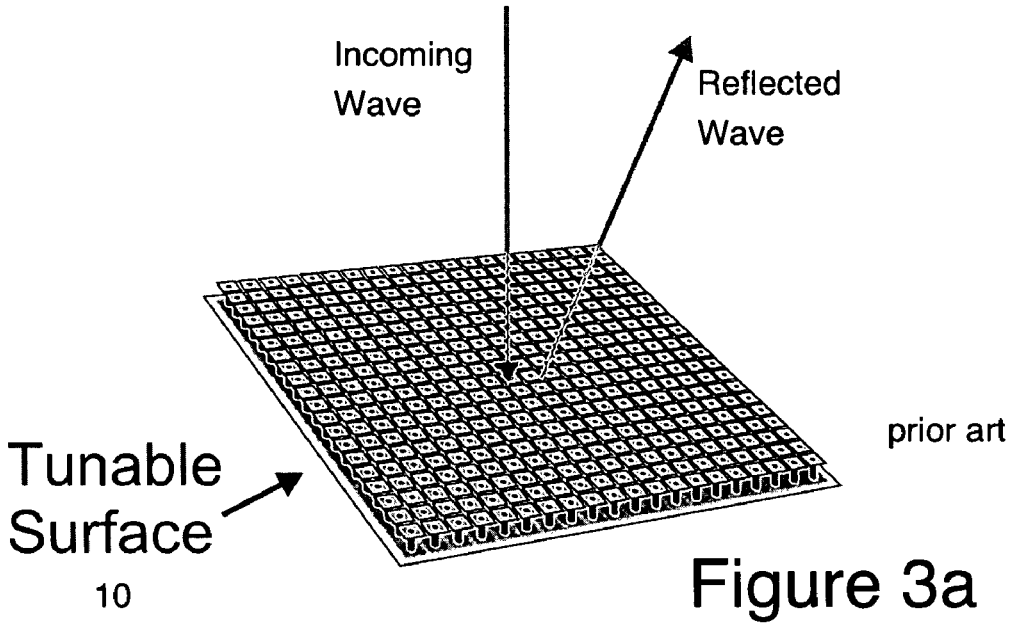
FIG. 3*a* depicts the traditional method of beam steering using a tunable impedance surface.
Figure 3B:
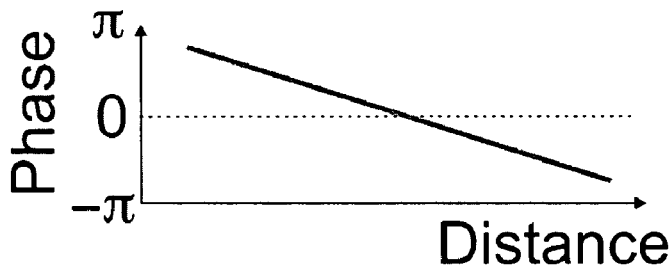
Figure 3b prior art
FIG. 3*b* depicts the reflection phase gradient for the tunable impedance surface of FIG. 3*a;*

All of these concepts are known or should be known by those skilled in the art, as is the basic concept of beam steering by explicit control of a reflection phase gradient, as shown in FIGS. 3*a* and 3*b*. The typical method of steering using this concept is as follows:

1. Measure the reflection phase versus frequency and voltage to build a calibration table.
2. Select a frequency of operation, and read the phase versus voltage from the table
3. Determine the angle to which you wish to steer.
4. Calculate the reflection phase gradient required for this steering angle.
5. Read the required voltages from the phase-voltage curve obtained from the calibration table.
6. Apply the voltages to the surface, and illuminate the surface with microwave energy.

These steps provide a method for steering a beam to a known angle; however, they do not provide a way of steering multiple beams or of forming and steering nulls to suppress jamming.

The presently disclosed technology addresses these issues by using a method of adaptive control, whereby the angles of interest do not need to be known, and the surface 10 does not need to be calibrated, so the phase also does not need to be known. The presently disclosed technology not only provides greater flexibility, but it tends to produce radiation patterns that are closer to optimum, because it can automatically account for phase errors due to the feed horn 20 and also cancel non-uniformities in the surface 10 due to manufacturing errors or variations among the tuning devices 18.

Figure 4:
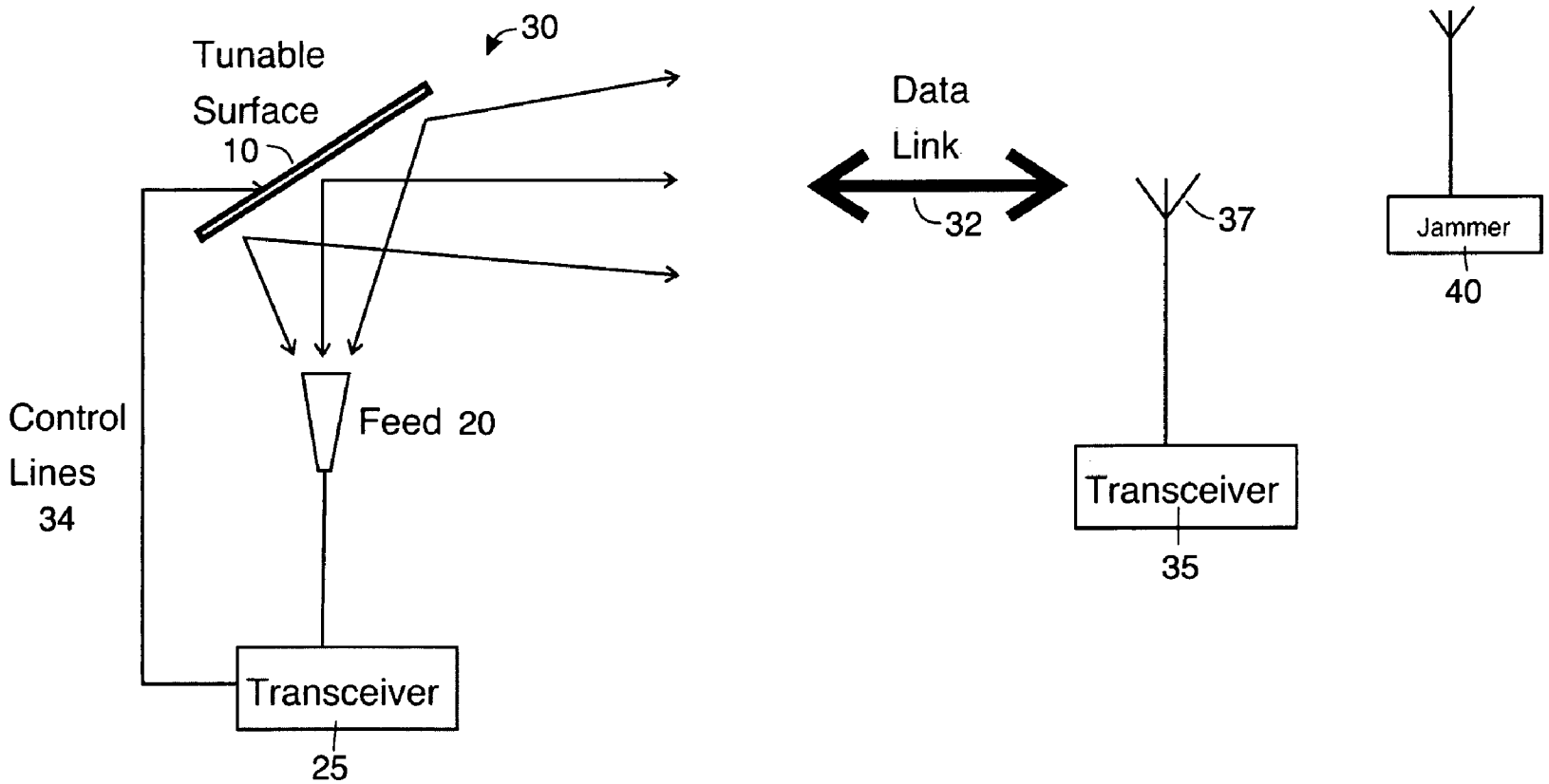
FIG. 4 is a schematic diagram of the general architecture of a communication system using an embodiment of the adaptive antenna.

The general architecture of a communication system using this adaptive technique is shown in FIG. 4. The tunable surface 10 is illuminated by a feed horn 20 that is attached to a receiver (which is preferably a transceiver) 25. The tunable surface 10 in combination with the feed horn 20 form an antenna 30. This transceiver 25 has a communication link 32 with another transceiver 35 that does not need to have a steerable antenna (such as antenna 30). A jammer 40 may also be present. The transceiver 25 of the steerable antenna 30 has an associated control system that is also connected to that antenna 30 with a series of control lines 34 that adjust the resonance frequency of the individual resonator cells 12 (see FIGS. 1*a* and 1*b*) associated with the tunable surface 10. The resonance frequencies of these cells 12 do not need to be known explicitly, and the reflection phase of the surface does not need to be known. In other words, the surface 10 does not need to be calibrated. Furthermore, the location of the remote transceiver unit 35 and its antenna 37 do not need to be known, nor the locations of any jammers 40 that may be present.

The general procedure for beam steering using this technique is as follows:

1. Arrange the feed horn 20 so that it illuminates the tunable surface 10;
2. Apply some initial set of control voltages, which can be arbitrary, to the tuning elements 18 via control lines 34.
3. For each resonator cell 12 in the surface 10, adjust the control voltage up, and down by a small amount, v.
4. Measure the received power for the cases of −v, 0, +v.
5. Keep the best of the three cases, and move to the next resonator cell 12 in the array of resonator cells 12 defining the tunable surface 10.
6. Repeat the voltage dithering (adjusting) and measurement sequence of steps 3–5 above, preferably continuously.

Figure 4A:
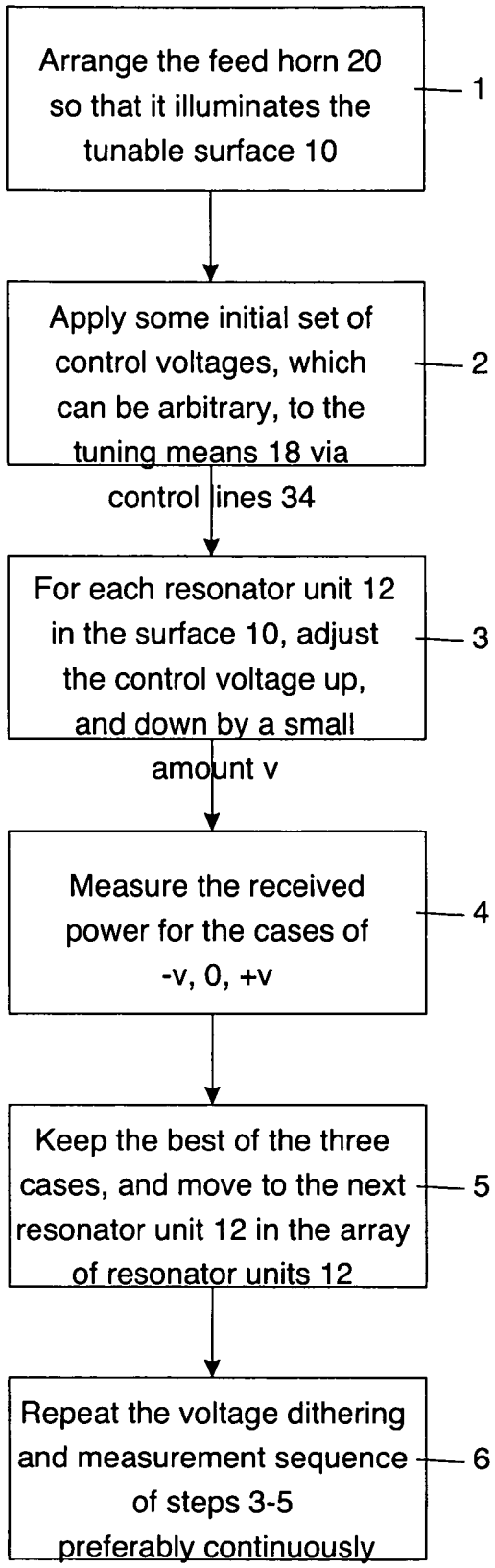
FIG. 4*a* is a flow diagram of a technique for tuning the tunable antenna in accordance with the present disclosure.

A flow diagram of the forgoing is depicted by FIG. 4*a*. Maximizing the Signal to Noise and Interference Ratio (SNIR) is one way of dealing with a jammer using this technique.

A typical tunable surface 10 might include many resonator cells 12 and it is to be understood that FIGS. 1*a* and 1*b* only show a few of the resonator cells 12 in a given surface 10 simply for the sake of clarity of illustration. Using the control system, under microprocessor control, for example, it should take relatively few instructions to carry out the procedure set forth above and given microprocessors that currently operate at several GHz, the surface 10 can be recalibrated many times each second.

While the basic method of adapting the tunable surface 10 is outlined above, the details will vary depending on the environment and the parameters to be optimized. For example, the measurement of the signal strength set forth above may include both the signals of interest, and the signals not of interest, such as those from a jammer 40, and thus the control system may need to be more selective. In the case of narrow band signals, the parameter to be measured may simply be the power in each band, which can be measured with a spectrum analyzer or other similar device in or associated with the control system. In the case of direct sequence spread spectrum signals, the parameter to be measured would be the correlation between the received spectrum and the known spreading code, which would indicate reception of the desired signal. If no jammers 40 are expected, and only one incoming signal is expected, then the parameter to be measured may simply be the received power, which can be measured with a broadband power detector in or associated with the control system.

The dithering voltage v is arbitrary, but its value will affect the rate of convergence of the adaptive antenna 30. It is generally chosen to be a small fraction of the overall tuning range of the devices that are used to tune the antenna 30, which are varactor diodes 18 in the case of the varactor-tuned surface 10 described above with reference to FIGS. 1*a* and 1*b*. The value of the dithering voltage v may also vary with time depending on the convergence of the received power to a stationary level. For example, the dithering voltage v can be set to a large value initially, for broad searches, and it can be gradually reduced as the adaptive antenna 30 finds a stationary control voltage of each device 18, indicating that the antenna system 30 has locked onto a signal source.

The parameter to be optimized need not be limited to a single signal power. If the antenna 30 is required to address multiple users 35 or to mitigate jammers 40, a cost function, such as SNIR, can be chosen that reflects these needs. For example, for multiple users 35, the antenna could be optimized so that the received power from each user 35 is the same, to reduce the effects of the near-far problem in CDMA. In this case, the parameter to be optimized could be chosen as the variance of the signal levels. To ensure that the antenna 30 did not converge on a solution where the received power from all users 35 was a near zero, the average signal power could also be included in the cost function. For example, the antenna 30 could be set to maximize the average power divided by the variance. To mitigate the effects of jammers 40, the antenna 30 can be set to optimize the total signal-to-interference ratio by the control system.

Figure 5:
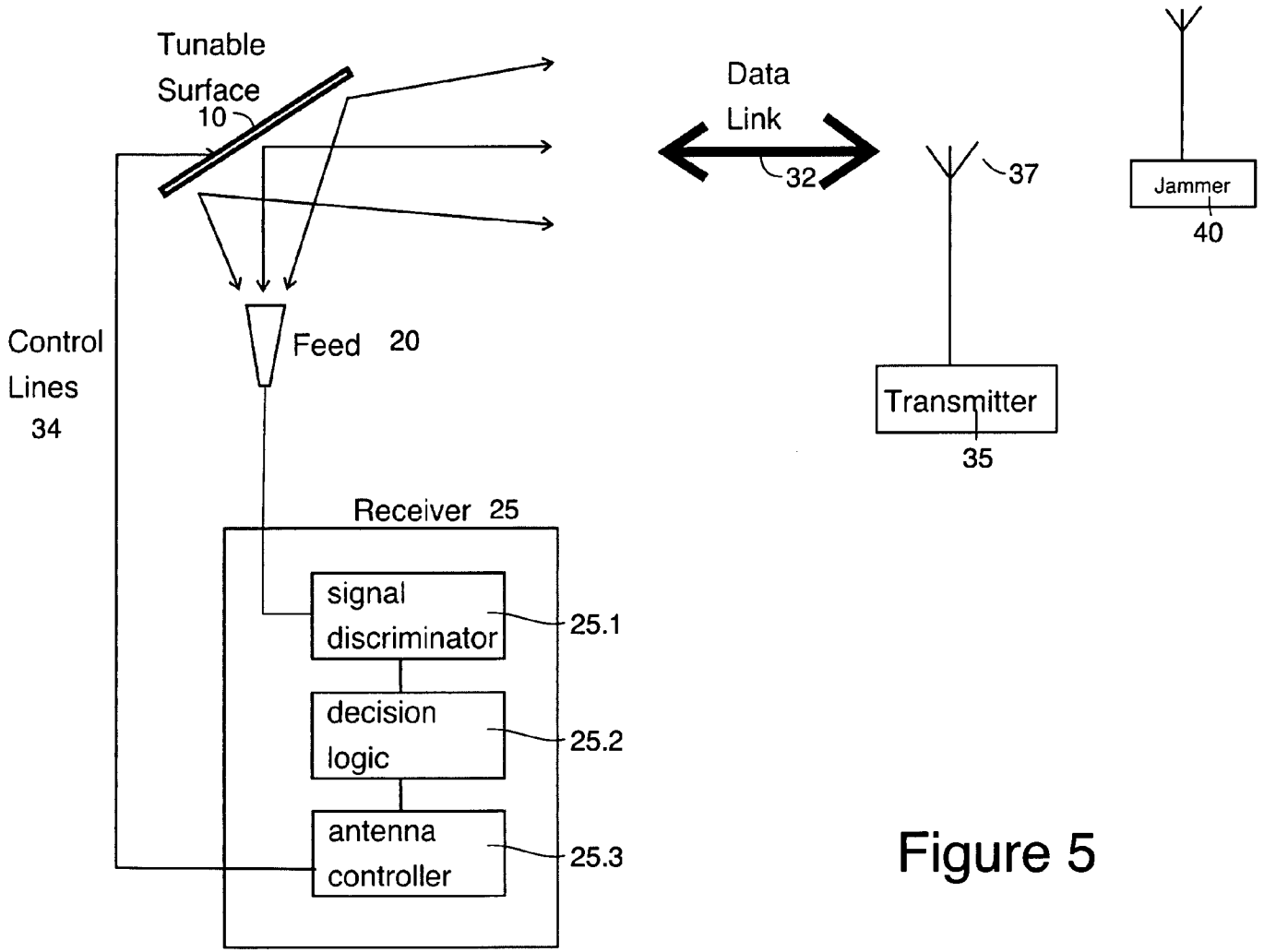
FIG. 5 is a schematic diagram of an embodiment of the disclosed technology where the adaptive antenna is controlled using the received signals, including both beam forming and jamming suppression.

A block diagram of the components which can be used to implement the beam forming method, described above, in a communication system is shown in FIG. 5. As indicated in this figure, the communication system may involve two-way transmissions between the nodes, but only the signals received by the node which contains the adaptive antenna are used for the beam steering and jam suppression in this embodiment. A receiver/controller 25 contains a device 25.1 that discriminates between the signals of interest and the signals not of interest such as jammers 40. This may be a correlator in the case of CDMA, or a spectrum analyzer or similar device in the case of narrowband channels. It may also be simply a measure of the final bit error rate of the communication system or of the SNIR. The output of device 25.1 is sent to a decision logic circuit 25.2 that tells an antenna controller 25.3 what effect the voltage dithering explained above has on the cost function. The antenna controller 25.3 sequentially dithers the voltages on all of the resonator cells 12 in the array, and holding each cell at a particular voltage value that produced the optimum result.

As can be seen, an embodiment of the control system discussed with reference to FIG. 4 (in connection with receiver 25) can be implemented by the signal discriminator 25.1, decision logic circuit 25.2 and the antenna controller 25.3 discussed above with reference to FIG. 5. Of course other implementations are possible, as has already been described with reference to the embodiment of FIG. 5 and as will be seen with reference to the embodiment of FIG. 6. Also, the receiver 25 and transmitter 35 in FIG. 5 could both be implemented as transceivers in order to allow two way communications.

This beam forming method only needs small sequential changes in the control voltages of the individual cells 12, nevertheless it can produce large-scale effects that require a coherent phase function across the entire surface. Using conventional methods, one typically must know the phase function of the antenna explicitly, which requires calibration. However, laboratory experiments have shown that the methods disclosed herein can steer the main beam over a wide range of angles and can adapt the main beam from one angle to a second angle differing by many tens of degrees. The disclosed method can also produce and steer deep nulls for anti-jamming capabilities.

Figure 6:
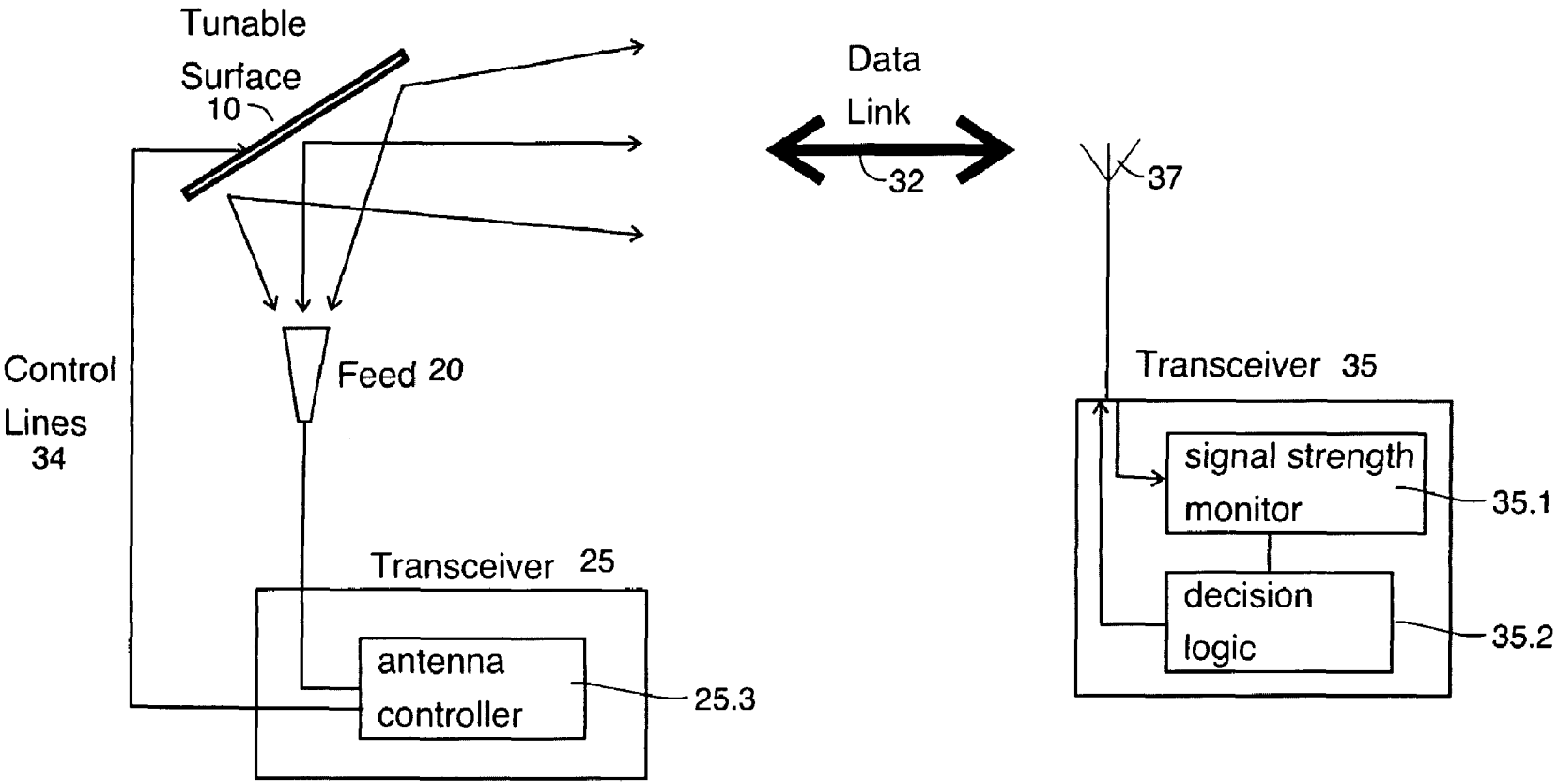
FIG. 6 Is a schematic diagram of another embodiment of the disclosed technology where the adaptive antenna is used for transmit and for receive, with the beam forming logic handled by the remote unit.

While the beam forming method requires a measurement of the received signal, it is not necessary that this measurement be performed at the node that contains the adaptive antenna itself. FIG. 6 shows an embodiment of the system where the remote node (transmitter 35) contains a signal strength monitor 35.1 (which may be implemented as signal strength estimation or measuring circuit, for example) and the decision logic circuit 35.2 (elements 35.1 and 35.2 generally correspond to elements 25.1 and 25.2 in the embodiment of FIG. 5), while the node (element 25) that is associated with adaptive antenna 10 includes only the antenna controller 25.3 in this embodiment. In this embodiment the remote node 35 constantly monitors the signal strength while the antenna controller 25.3 dithers the control voltages on lines 34. The remote node 35 determines the effect of each voltage change, calculates the cost function (e.g., the SNIR), determines which voltage values to keep, and sends the results to the antenna controller 25.3 via receiver 25. Thus receiver 25 is preferably actually a transceiver and transmitter 35 is also preferably a transceiver. Alternatively, the decision logic circuit 25.2 may be located with the antenna controller (as done in the embodiment of FIG. 5), and only a signal strength estimation or measuring circuit, such as signal strength monitor 35.1, need be located at the remote node 35. The intelligence can be distributed in many ways between the two nodes 25, 35, but it is believed to be preferable to put all of the intelligence in one location.

Of course, because each node is measuring a different quantity, these different methods will produce different results, which can be used to optimize the system for different environments.

Figure 7:
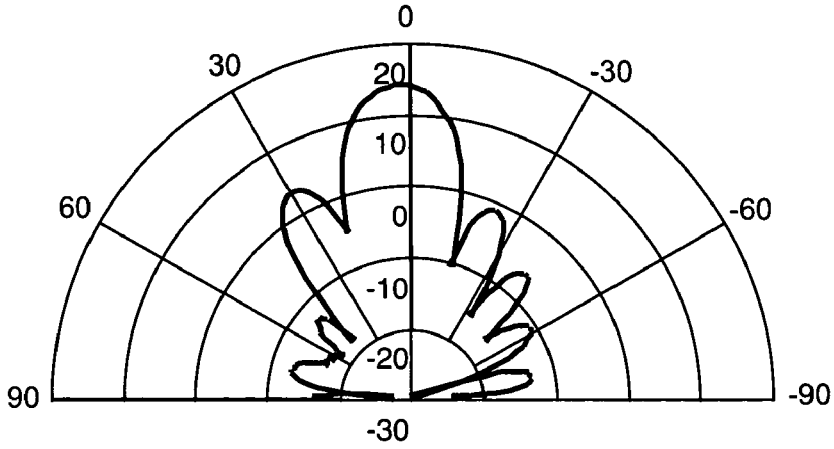
FIG. 7 is a graph of the radiation pattern with the adaptive antenna steered to 0 degrees.
Figure 8:
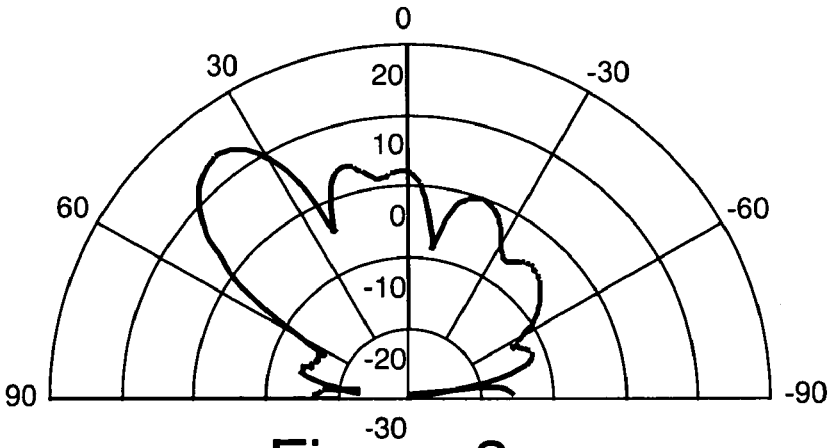
FIG. 8 is a graph of the radiation pattern with the adaptive antenna steered to 40 degrees.
Figure 9:
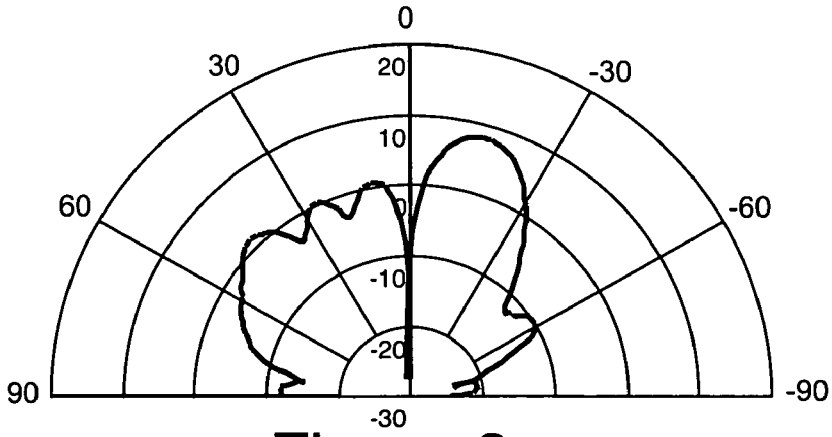
FIG. 9 is a graph of the radiation pattern with the adaptive antenna forming a null at 0 degrees.

The adaptive antenna system has been demonstrated in the laboratory, and several results are shown in FIGS. 7–9. FIG. 7 shows the radiation pattern for a case where the antenna has been optimized for boresight radiation, or 0 degrees. The only value that was used for the optimization was the received power at 0 degrees. Nonetheless, the radiation pattern is nearly ideal, with the main lobe at 0 degrees, and the sidelobes are roughly 10 dB lower than the main beam. FIG. 8 shows a case where the antenna has been optimized for 40 degrees. Again, the radiation pattern shows low sidelobes and a narrow main beam. In both of these cases, the beam forming method described herein produced a narrower beam than was possible using a linear reflection phase function, which represents the conventional, prior-art method. This improvement is because the beam forming method was able to adapt for the phase curvature of the feed horn 20 and eliminate variations in the surface due to differences in the varactor diodes 18. FIG. 9 shows a case where the antenna has been optimized to produce a null in the forward direction, such as could be used to suppress a jammer in that direction.

Figure 10:
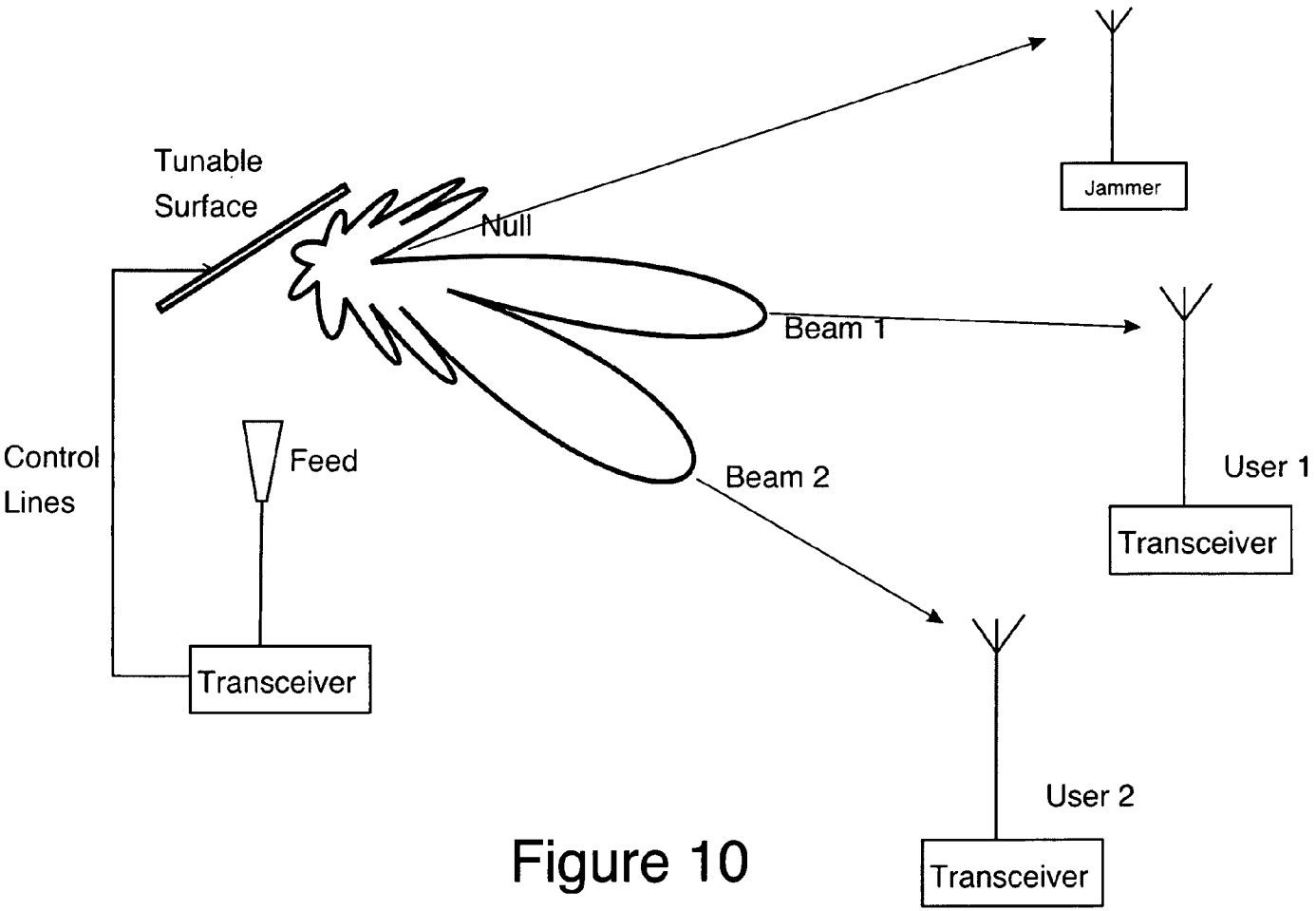
FIG. 10 illustrates how the disclosed adaptive antenna system can address multiple users with multiple beams, and also form nulls in the direction of a jammer.

FIG. 10 shows how the adaptive antenna could be used to build a complete communication system involving multiple users and also jammers. As described earlier, the antenna can be optimized for a variety of parameters, including minimizing the variance among several users, and maximizing the signal-to-interference ratio.

The tuning elements or means 18 are preferably embodied as varactor diodes, but other variable impedance devices could be used. For example, MEMS capacitors could be used, including optically sensitive MEMS capacitors, in which case the control lines 34 which penetrate the ground plane 16 would be implemented by optical cables.

Also, each side of a plate 11 which confronts a side on an adjacent plate preferably has an associated tuning element 18 for adjusting the capacitance between the sides of the adjacent plates 11. If the control voltages are applied using electrically conductive lines 34, then the scheme shown in FIGS. 1*a* and 1*b* wherein essentially one half of the plates 11 are grounded and the other half of the plates 11 have control voltages applied thereto, tends to simplify the application of the control voltages to the tuning elements 18 using electrical conductors. However, if optically controlled MEMS capacitors are used for the tuning elements 18, then it becomes much easier to individually control each and every tuning element 18. When the tuning elements 18 are controlled using electrically conductive control lines 34, then it is easier to control the tuning elements 18 by groups (where a group comprises those tuning elements 18 coupled to a common control line 34) than trying to control the tuning elements 18 individually by electrically conductive control lines 34 (since then additional electrically conductive penetrations of the surface 10 would then be called for adding considerably to the complexity of the resulting surface 10). Thus, the control lines 34 adjust a group of tuning elements 18, it being understood that a group may comprise a single tuning element in certain embodiments.

In the embodiment of FIGS. 1*a* and 1*b* the tuning elements 18 are implemented as varactor diodes, which are depicted schematically in these figures. Printed circuit board construction techniques can be conveniently used to make surface 10 and therefore varactor diodes (if used) can be conveniently applied to surface 10 using surface mount technologies.

Having described this technology in connection with a number of embodiments, modification will now certainly suggest itself to those skilled in the art. As such, the appended claims are not to be limited to the disclosed embodiments except as specifically required by the appended claims.

What is claimed is:

1. A method of beam steering comprising:

a. arranging an antenna so that the antenna radiates a tunable impedance surface with RF radiation, the tunable impedance surface having a plurality of tunable resonator cells, each resonator cell being tunable by at least one tuning element associated therewith;

b. applying an initial set of control signals to the tuning elements associated with the tunable impedance surface group by group;

c. adjusting the coritrol signal up and down by an incremental amount v for a selected group;

d. transmitting and/or receiving an RE signal which is reflected from the tunable impedance surface and measuring a parameter associated with power of the transmitted and/or received RE signal for three cases of −v, 0, and +v adjustments of the control signal for said selected group;

e. noting a best value of the control signal for the three cases and setting the control signal accordingly for said selected group and adjusting the control signal up and down by said incremental amount v for another selected group;

f. repeating steps d and e to adjust the tuning elements for said another selected group until all the tuning elements have been adjusted; and g. repeating steps c–f to adjust the tuning elements for a period of time.

2. The method of claim 1 wherein in step g the incremental amount v is decreased during said period of time.

3. The method of claim 1 wherein adjusting the control signal up and down by said incremental amount v for a selected one of the resonator cells causes the resonance of the selected one of the resonator cells to vary step-wise.

4. The method of claim 3 wherein adjusting the control signal up and down by said incremental amount v for another selected one of the resonator cells causes the resonance of the another selected one of the resonator cells to vary step-wise.

5. The method of claim 1 wherein said antenna is a horn type antenna.

6. The method of claim 1 wherein the tuning elements associated with the plurality of tunable resonator cells comprise individually tunable variable impedance devices.

7. The method of claim 6 wherein the variable impedance devices comprise varactor diodes and the control signals comprise control voltages.

8. A method of beam steering comprising:

a. arranging an antenna so that the antenna radiates from a tunable impedance surface with RF radiation, the tunable impedance surface having a plurality of tunable resonator cells, each resonator cell having a reactance tunable by at least one tuning element associated therewith; and b. sequentially adjusting tuning elements associated with the tunable impedance surface so that resonances of the tunable resonator cells are varied in a sequence and setting the resonances of the tunable resonator cells to values determined based on said sequence which improve transmission of information via said tunable impedance surface and said antenna.

9. The method of claim 8 wherein the resonances of the tunable resonator cells are varied step-wise in said sequence.

10. The method of claim 9 wherein the step-wise variance of the resonances of the tunable resonator cells decreases over a period of time.

11. The method of claim 8 wherein the tuning elements are voltage controlled capacitors.

12. The method of claim 11 wherein the adjusting of tuning elements associated with the tunable impedance surface is performed by adjusting a control voltage supplied to each voltage controlled capacitor.

13. The method of claim 12 wherein the adjusting of the control voltages supplied to said voltage controlled capacitors is performed step-wise.

14. The method of claim 13 wherein the step-wise variance of the control voltages supplied to said voltage controlled capacitors decreases over a period of time.

15. The method of claim 14 wherein the information whose transmission is improved is desired information and wherein reception of undesired information is diminished.

16. The method of claim 8 wherein the resonances of the tunable resonator cells are varied in said sequence by varying a control voltage applied to the tuning elements in a predetermined pattern for each tuning element associated with said plurality of tunable resonator cells.

17. The method of claim 16 wherein said predetermined pattern includes increasing and decreasing the control voltage applied to the tuning elements and wherein the resonances of the tunable resonator cells are each set based on a preferred control voltage selected in accordance with said predetermined pattern for each tunable resonator cell in said plurality of tunable resonator cells.

18. A communication system comprising:

a. an antenna;

b. a tunable impedance surface disposed to reflect RF radiation between at least one communications link and said antenna, the tunable impedance surface having a plurality of tunable resonator cells arranged in a two dimensional array, each resonator cell having a reactance that is tunable by at least one tuning element associated therewith;

c. a receiver, and controller coupled to said antenna, the receiver and controller including a signal discriminator for measuring one or more parameters associated with communication quality of service over said at least one communications link, the receiver and controller sequentially adjusting the tuning elements associated with the tunable resonator cells in said tunable impedance surface in order to improve the communication quality of service over said at least one communications link.

19. The communication system of claim 18 wherein the antenna is a feed horn.

20. The communication system of claim 18 wherein the tuning elements associated with the tunable resonator cells are variable impedance devices.

21. The communication system of claim 18 wherein the receiver and cpntroller:

a. apply an initial set of control signals to the tuning elements associated with the tunable impedance surface, the tuning elements being arranged in groups having one or more tuning elements for each group;

b. adjust the control signal up and down by an incremental amount v for a selected group of one or more tuning elements;

c. receive an RF signal which is reflected from the tunable impedance surface and measure a parameter associated with power of the transmitted and/or received RF signal for three cases of −v, 0, and +v adjustments of the control signal for the selected group of one or more tuning elements;

d. note a best value of the control signal for the three cases and set the control signal accordingly for said selected one of the groups of one or more tuning elements and adjusting the control signal up and down by said incremental amount v for another selected one of the tuning elements;

e. repeat items c and d to adjust each of the groups tunable tuning elements associated with the tunable impedance surface; and f. repeat items b–e to adjust all tuning elements associated with the tunable impedance surface in a continuous pattern for a period of time.

22. A method of beam steering comprising:

a. arranging an antenna so that the antenna radiates a tunable impedance surface with RF radiation, the tunable impedance surface having tuning elements associated with the tunable impedance surface, the tuning elements being arranged in groups having one or more tuning elements for each group;

b. applying an initial set of control signals to the groups of one or more tuning elements associated with the tunable impedance surface;

c. adjusting the control signal by an incremental amount v for a selected group of one or more tuning elements;

d. receiving and/or transmitting an RF signal which is reflected from the tunable impedance surface and measuring a parameter associated with power of the transmitted and/or received RE signal for three cases of −v, 0, and +v adjustments of the control signal for the selected group of one or more tuning elements;

e. noting a best value of the control signal for the three cases and setting the control signal accordingly for said selected one of the groups of one or more tuning elements and adjusting the control signal by said incremental amount v for another selected one of the tuning elements;

f. repeating subparagraphs d and e to adjust each of the groups tunable tuning elements associated with the tunable impedance surface; and g. repeating subparagraphs b–e to adjust all tuning elements associated with the tunable impedance surface in a continuous pattern for a period of time.

23. The method of claim 22 wherein the tuning elements comprise an array of resonator cells, the array of resonator cells being defined by an array of plates (i) disposed on a dielectric surface and (ii) spaced from a ground plane by a distance which is less than one quarter wavelength of a frequency of the RF radiation.

24. A method of beam steering comprising:

a. arranging an antenna relative to a tunable impedance surface so that RF radiation reflects from the tunable impedance surface, RF radiation either being transmitted from the antenna and/or received thereby via said tunable impedance surface, the tunable impedance surface having a plurality of tunable resonator cells, each resonator cell having, a reactance tunable by at least one tuning element associated therewith;

b. tuning the tuning elements associated with each tunable resonator cell in a predetermined pattern so that resonance of each tunable resonator cell is tuned according to said pattern and wherein said tuning elements are sequentially tuned so that all of tuning elements associated with said plurality of tunable resonator cells are eventually tuned according to said pattern; and c. setting the resonances of the tunable resonator cells to values selected based on said predetermined pattern.

* * * * *